US005813531A

United States Patent [19]

Kao

[11] Patent Number: 5,813,531

[45] Date of Patent: Sep. 29, 1998

[54] TOOL BOX ASSEMBLY

[76] Inventor: Jui-Chien Kao, No. 358, Tunghsing Rd., Shuwang Li, Tali City, Taichung Hsien, Taiwan

[21] Appl. No.: 978,405

[22] Filed: Nov. 25, 1997

[51] Int. Cl.[6] ..... B65D 85/28

[52] U.S. Cl. ..... 206/373; 206/375; 206/378; 220/756

[58] Field of Search ..... 206/372, 373, 206/375, 376, 377, 378; 312/902; 220/735, 756, 760, 770, 775

[56] References Cited

U.S. PATENT DOCUMENTS

| | | | |
|---|---|---|---|
| 1,997,043 | 4/1935 | Clark | 220/333 |
| 2,532,636 | 12/1950 | Minnich | 206/377 |
| 3,892,331 | 7/1975 | Beck | 206/378 |
| 4,420,079 | 12/1983 | Gliniorz et al. | 220/331 |
| 5,203,469 | 4/1993 | Chang et al. | 206/372 |
| 5,325,966 | 7/1994 | Chang | 206/372 |
| 5,398,810 | 3/1995 | Wang | 206/373 |

*Primary Examiner*—David T. Fidei
*Attorney, Agent, or Firm*—Bacon & Thomas

[57] ABSTRACT

A tool box assembly includes a tool box including two side walls each having a first end portion defining a slot. An inverted U-shaped lid includes two side plates each having a first end portion defining an inverted L-shaped channel and a second end portion pivotally mounted on a second end portion of a corresponding one of the two side walls of the tool box. The channel of each of the two side plates includes a longitudinal recess alignable with the slot and a recess perpendicular to the longitudinal recess. A U-shaped handle includes two legs. Two snapping members each include a stub fixedly mounted on a corresponding one of the two legs of the handle and slidably extending through the longitudinal recess of a corresponding one of the two side plates of the lid and through the slot of an associated side wall of the tool box, and a cone-shaped enlarged head urged on an inner periphery of the side wall of the tool box.

5 Claims, 6 Drawing Sheets

TOOL BOX ASSEMBLY

FIELD OF THE INVENTION

The present invention relates to a tool box assembly.

BACKGROUND OF THE INVENTION

A conventional tool box is shown in FIGS. 6 and 7, and a complete illustration will follow in the detailed description of the preferred embodiments.

The present invention has arisen to mitigate and/or obviate the disadvantage of the conventional tool box.

SUMMARY OF THE INVENTION

In accordance with one aspect of the present invention, there is provided a tool box assembly comprising a tool box including two elongate side walls each having a first end portion defining an elongate slot longitudinally disposed and a second end portion.

An inverted U-shaped lid includes two side plates each juxtaposed to a corresponding one of the two side walls of the tool box and each having a first end portion defining an inverted L-shaped channel and a second end portion pivotally mounted on the second end portion of a corresponding one of the two side walls of the tool box.

The channel of each of the two side plates includes an elongate recess longitudinally disposed and alignable with the elongate slot of an associated side wall of the tool box, and a short recess perpendicularly disposed to the elongate recess.

A U-shaped handle includes two legs each slidably mounted on the first end portion of a corresponding one of the two side walls of the tool box.

Two snapping members each include a stub fixedly mounted on a corresponding one of the two legs of the handle and slidably extending through the elongate recess of a corresponding one of the two side plates of the lid and through the elongate slot of an associated side wall of the tool box, and a cone-shaped enlarged head extending from one end portion of the stub and urged on an inner periphery of the side wall of the tool box.

Further features of the present invention will become apparent from a careful reading of the detailed description with appropriate reference to the accompanying drawings.

DETAILED DESCRIPTION OF THE PREFERRED EMBODIMENTS

Figure 6:
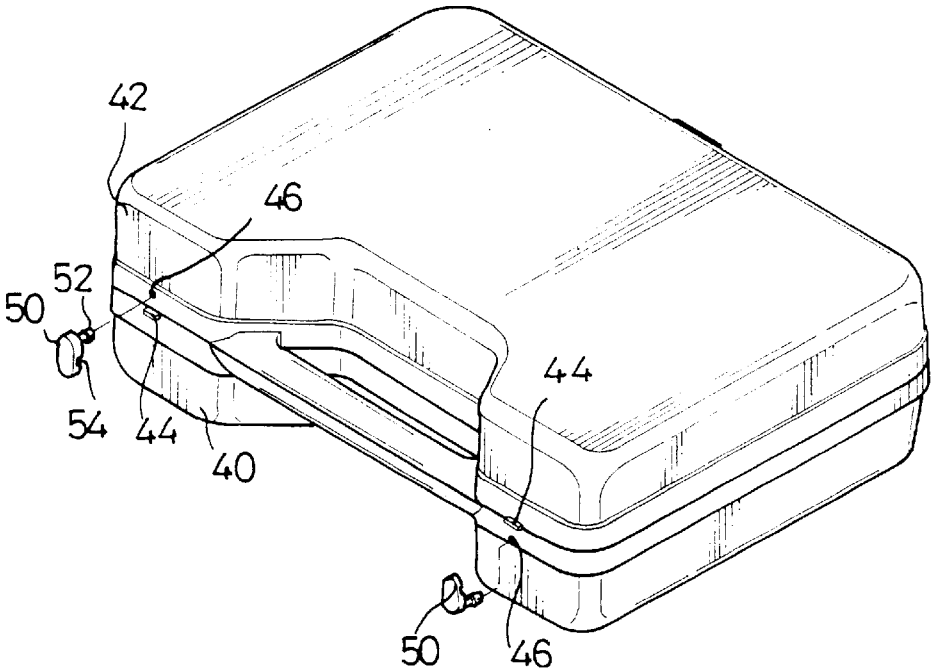
FIG.6 PRIOR ART
FIG. 6 is a perspective view of a conventional tool box in accordance with the prior art.
Figure 7:
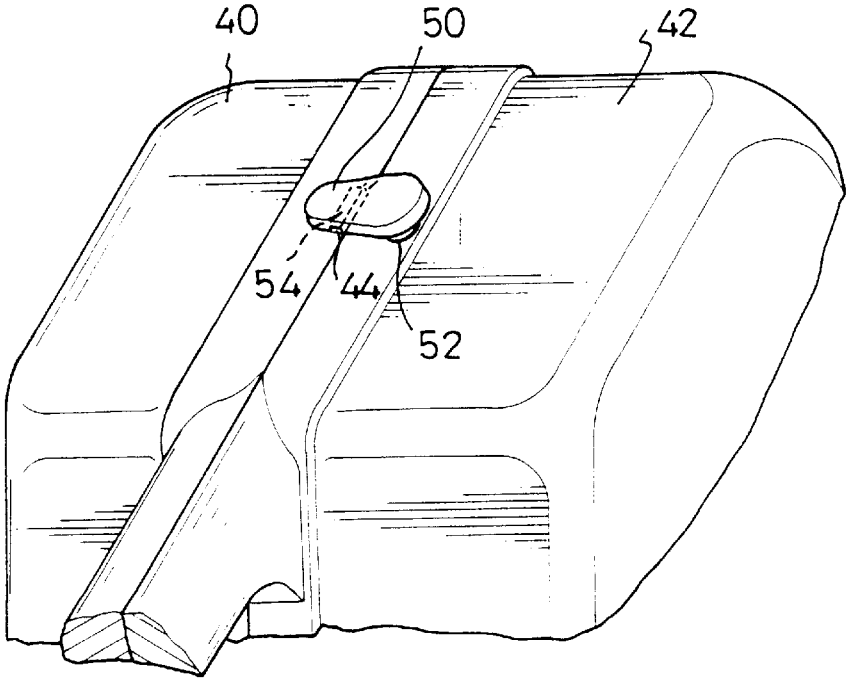
FIG.7 PRIOR ART
FIG. 7 is an partially enlarged view of the tool box shown in FIG. 6.

For a better understanding of features and benefits of the present invention, reference is now made to FIGS. 6 and 7, illustrating a conventional tool box in accordance with the prior art.

The conventional tool box comprises a body 40 pivotally connected with a lid 42, each of the body 40 and the lid 42 formed with a projection 44 and defining a hole 46. Two pivot members 50 are each pivotally mounted on each of the body 40 and the lid 42. Each of the two pivot members 50 includes a boss 52 received in a respective hole 46 and defines a cavity 54 for receiving a respective projection 44.

In operation, each of the two pivot members 50 can be pivoted relative to the projection 44 to a position as shown in FIG. 7 such that each of the two projections 44 can be received in a respective cavity 54, thereby securing the lid 42 on the body 40.

By such an arrangement, however, the engagement between the projection 44 and the cavity 54 easily becomes loosened during long-term utilization such that the lid 42 tends to be detached from the body 40, thereby greatly causing an inconvenience for carrying the tool box.

Figure 1:
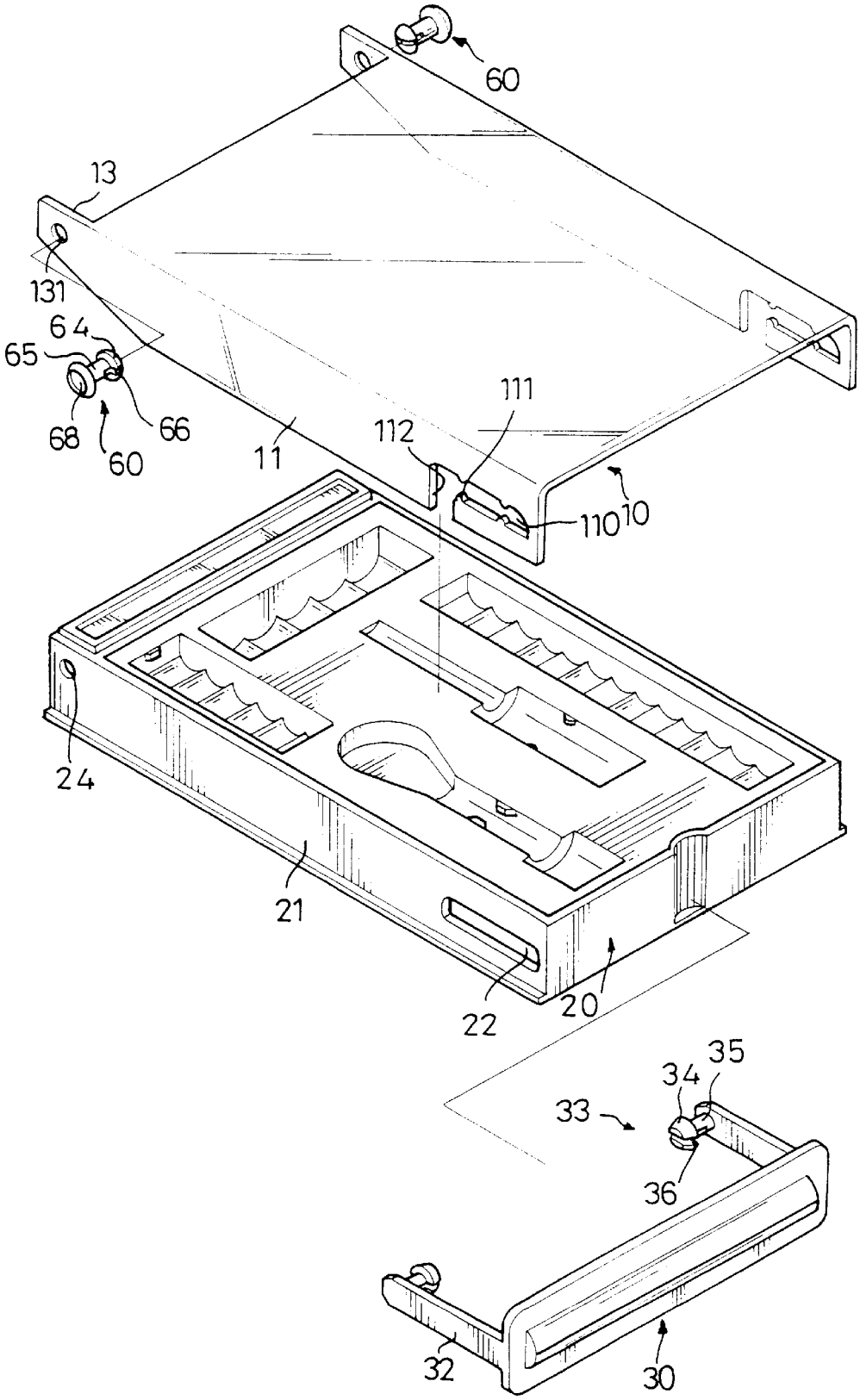
FIG. 1 is an exploded view of a tool box assembly according to the present invention.
Figure 2:
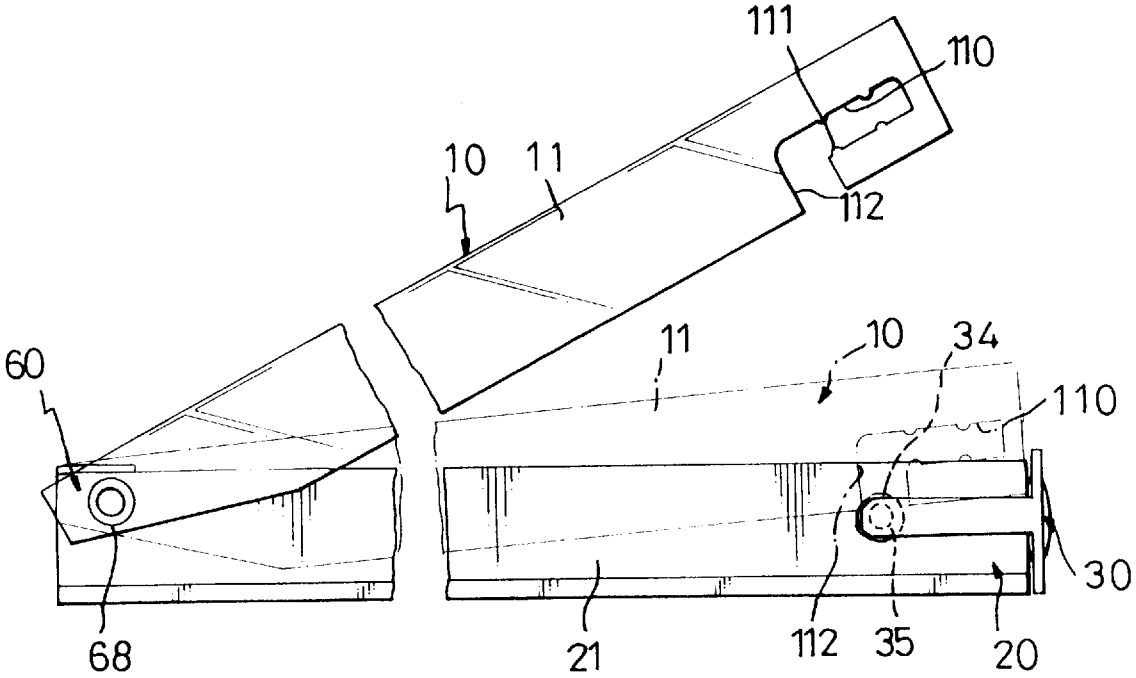
FIG. 2 is a front plan assembly view of the tool box assembly shown in FIG. 1.
Figure 3:
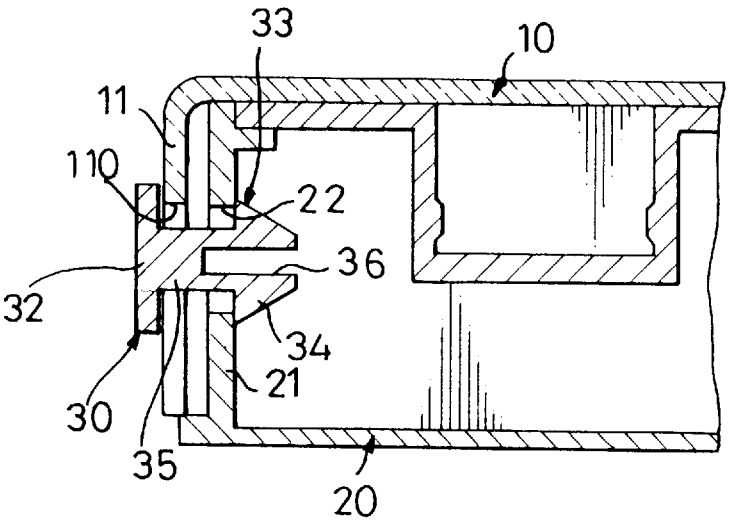
FIG. 3 is a partially side cross-sectional assembly view of the tool box assembly shown in FIG. 1.

Referring now to FIGS. 1–3, a tool box assembly in accordance with the present invention comprises a tool box 20 including two elongate side walls 21 each having a first end portion defining an elongate slot 22 longitudinally disposed and a second end portion.

An inverted U-shaped lid 10 includes two side plates 11 each juxtaposed to a corresponding one of the two side walls 21 of the tool box 20 and each having a first end portion defining an inverted L-shaped channel and a second end portion pivotally mounted on the second end portion of a corresponding one of the two side walls 11 of the tool box 20.

The channel of each of the two side plates 11 includes an elongate recess 110 longitudinally disposed and alignable with the elongate slot 22 of an associated side wall 21 of the tool box 20, and a short recess 112 perpendicularly disposed to the elongate recess 110.

The elongate recess 110 of each of the two side plates 11 is formed with a plurality of projections 111 extending inwardly.

A U-shaped handle 30 includes two legs 32 each slidably mounted on the first end portion of a corresponding one of the two side walls 21 of the tool box 20.

Two snapping members 33 each include a stub 35 fixedly mounted on a corresponding one of the two legs 32 of the handle 30 and slidably extending through the elongate recess 110 of a corresponding one of the two side plates 11 of the lid 10 and through the elongate slot 22 of an associated side wall 21 of the tool box 20, and a cone-shaped enlarged head 34 extending from one end portion of the stub 35 and urged on an inner periphery of the side wall 21 of the tool box 20 as best shown in FIG. 3. The cone-shaped enlarged head 34 of each of the two snapping members 33 defines a slit 36 therein.

The second end portion of each of the two side walls 21 of the tool box 20 defines a bore 24, and the second end portion of each of the two side plates 11 of the lid 10 is formed with an extension 13 defining a hole 131 aligning with the bore 24 of a corresponding one of the two side walls 21 of the tool box 20.

The tool box assembly further comprises two pivot members 60 each including a stub 65 extending through the hole 131 of a corresponding one of the two side plates 11 of the lid 10 and through the bore 24 of an associated side wall 21 of the tool box 20, a cone-shaped enlarged head 64 formed on a first end portion of the stub 65 and urged on an inner periphery of the side wall 21 of the tool box 20, and an abutting knob 68 formed on a second end portion of the stub 65 and urged on an outer periphery of the side wall 21 of the tool box 20. The cone-shaped enlarged head 64 of each of the two pivot members 60 defines a slit 66 therein.

In operation, referring to FIGS. 2–5 with reference to FIG. 1, the enlarged head 34 of each of the two snapping members 33 can be urged through the elongate slot 22 into the side wall 21 of the tool box 20, thereby urging on the inner periphery of the side wall 21 of the tool box 20 such that the handle 30 can slide along the elongate slot 22.

Then, the enlarged head 64 of each of the two pivot members 60 can be urged through the hole 131 and the bore 24 into the side wall 21 of the tool box 20, thereby urging on the inner periphery of the side wall 21 of the tool box 20 such that the lid 10 is pivotally mounted on the tool box 20 as shown in FIG. 2.

The lid 10 can then be pivoted relative to the tool box 20 to a position as shown in phantom lines in FIG. 2 such that the stub 35 of each of the two snapping members 33 can be inserted into the short recess 112 to align with the elongate recess 110 and the elongate slot 22 as shown in FIG. 3.

Figure 4:
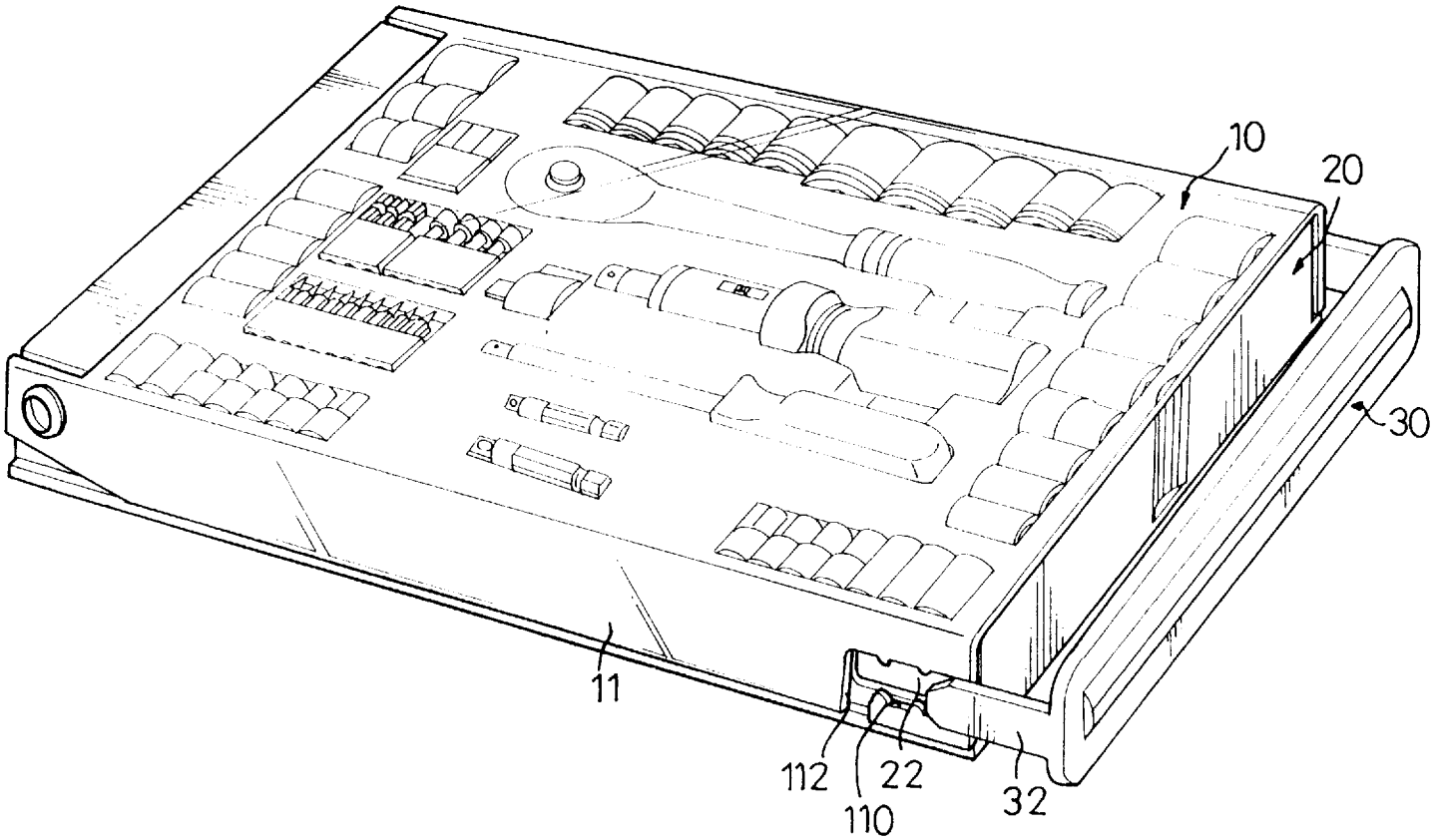
FIG. 4 is a perspective assembly operational view of the tool box assembly shown in FIG. 1.
Figure 5:
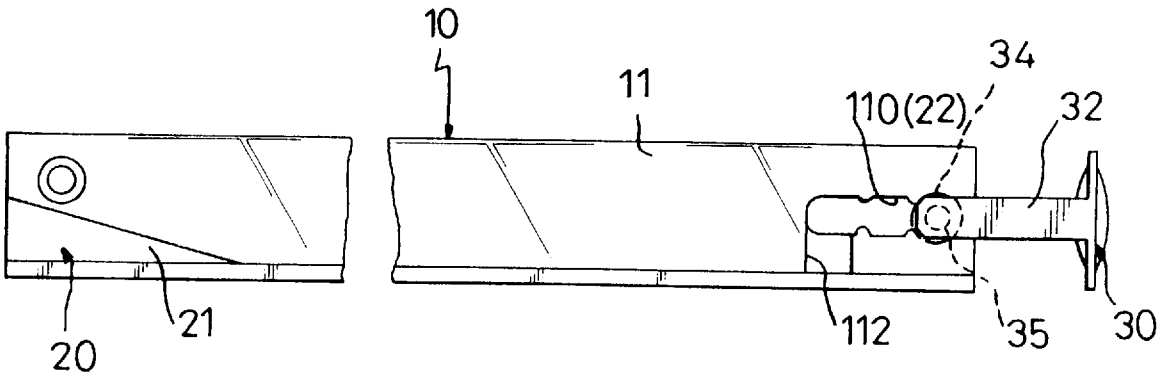
FIG. 5 is a front plan view of FIG. 4.

In such a situation, each of the two legs 32 of the handle 30 together with the stub 35 of each of the two snapping members 33 can be moved along the elongate recess 110 and the elongate slot 22 to a position as shown in FIGS. 4 and 5 such that the lid 10 can be secured on the tool box 20.

It should be clear to those skilled in the art that further embodiments of the present invention may be made without departing from the spirit and scope of the present invention.

What is claimed is:

1. A tool box assembly comprising:

a tool box (20) including two elongate side walls (21) each having a first end portion defining an elongate slot (22) longitudinally disposed and a second end portion;

an inverted U-shaped lid (10) including two side plates (11) each juxtaposed to a corresponding one of said two side walls (21) of said tool box (20) and each having a first end portion defining an inverted L-shaped channel and a second end portion pivotally mounted on said second end portion of a corresponding one of said two side walls (11) of said tool box (20), said channel of each of said two side plates (11) including an elongate recess (110) longitudinally disposed and alignable with said elongate slot (22) of an associated said side wall (21) of said tool box (20), and a short recess (112) perpendicularly disposed to said elongate recess (110);

a U-shaped handle (30) including two legs (32) each slidably mounted on said first end portion of a corresponding one of said two side walls (21) of said tool box (20); and two snapping members (33) each including a stub (35) fixedly mounted on a corresponding one of said two legs (32) of said handle (30) and slidably extending through said elongate recess (110) of a corresponding one of said two side plates (11) of said lid (10) and through said elongate slot (22) of an associated said side wall (21) of said tool box (20), and a cone-shaped enlarged head (34) extending from one end portion of said stub (35) and urged on an inner periphery of said side wall (21) of said tool box (20).

2. The tool box assembly in accordance with claim 1, wherein said cone-shaped enlarged head (34) of each of said two snapping members (33) defines a slit (36) therein.

3. The tool box assembly in accordance with claim 1, wherein said elongate recess (110) of each of said two side plates (11) is formed with a plurality of projections (111) extending inwardly.

4. The tool box assembly in accordance with claim 1, wherein said second end portion of each of said two side walls (21) of said tool box (20) defines a bore (24), and said second end portion of each of said two side plates (11) of said lid (10) is formed with an extension (13) defining a hole (131) aligning with said bore (24) of a corresponding one of said two side walls (21) of said tool box (20), and said tool box assembly further comprises two pivot members (60) each including a stub (65) extending through said hole (131) of a corresponding one of said two side plates (11) of said lid (10) and through said bore (24) of an associated said side wall (21) of said tool box (20), a cone-shaped enlarged head (64) formed on a first end portion of said stub (65) and urged on an inner periphery of said side wall (21) of said tool box (20), and an abutting knob (68) formed on a second end portion of said stub (65) and urged on an outer periphery of said side wall (21) of said tool box (20).

5. The tool box assembly in accordance with claim 4, wherein said cone-shaped enlarged head (64) of each of said two pivot members (60) defines a slit (66) therein.

* * * * *